US007810946B2

(12) United States Patent
Jarzac et al.

(10) Patent No.: US 7,810,946 B2
(45) Date of Patent: Oct. 12, 2010

(54) PORTABLE LIGHTING LAMP EQUIPPED WITH A PRINTED CIRCUIT CARD HOUSED IN A TIGHTLY SEALED ENVIRONMENT, AND METHOD FOR ASSEMBLING THE LAMP

(75) Inventors: Sebastien Jarzac, Grenoble (FR); Stephane Huguenin, Grenoble (FR); Paul Petzl, Barraux (FR)

(73) Assignee: Zedel, Crolles (FR)

( * ) Notice: Subject to any disclaimer, the term of this patent is extended or adjusted under 35 U.S.C. 154(b) by 100 days.

(21) Appl. No.: 12/222,365

(22) Filed: Aug. 7, 2008

(65) Prior Publication Data

US 2009/0103291 A1 Apr. 23, 2009

(30) Foreign Application Priority Data

Oct. 23, 2007 (FR) ..... 07 07435

(51) Int. Cl.
*F21L 4/04* (2006.01)
*F21V 29/00* (2006.01)

(52) U.S. Cl. ..... 362/204; 362/190; 362/191; 362/646; 362/265; 362/267

(58) Field of Classification Search ..... 362/158, 362/195, 200, 204, 208, 190, 191, 646, 265, 362/396, 800, 267
See application file for complete search history.

(56) References Cited

U.S. PATENT DOCUMENTS

| | | | | |
|---|---|---|---|---|
| 6,614,336 | B2 * | 9/2003 | Galli | 335/205 |
| 2006/0067077 | A1 | 3/2006 | Kumthampinij et al. | |
| 2007/0177376 | A1 | 8/2007 | Simoni | |
| 2009/0027900 | A1 * | 1/2009 | Janos et al. | 362/373 |

* cited by examiner

*Primary Examiner*—Jacob Y Choi
(74) *Attorney, Agent, or Firm*—Oliff & Berridge, PLC

(57) ABSTRACT

A lighting lamp having an enclosure housing a DC power source and contact parts for connection to a printed circuit card connected with a light-emitting diode. The contact parts comprise first contact elements electrically connected with the power source and second contact elements designed to pass successively through a pair of holes situated in a tight intermediate wall of the enclosure and a through a pair of slots of the card. Soldering of the second contact elements onto the card, in addition to electric connection of the power source, enables a tightly sealed compartment to be achieved in the enclosure around the card.

8 Claims, 7 Drawing Sheets

PORTABLE LIGHTING LAMP EQUIPPED WITH A PRINTED CIRCUIT CARD HOUSED IN A TIGHTLY SEALED ENVIRONMENT, AND METHOD FOR ASSEMBLING THE LAMP

BACKGROUND OF THE INVENTION

The invention relates to a lighting lamp having an enclosure housing:

a DC power source electrically connected by contact parts to a printed circuit card supplying at least one light-emitting diode, said contact parts having first contact elements in electrical connection with the power source, and a switch controlling the state and the lighting level of said light-emitting diode.

STATE OF THE ART

In known portable lighting lamps, the lighting level of the light-emitting diodes is generally adjusted by means of an electronic circuit controlled by at least one switch. The electronic circuit comprises a printed circuit card on which the different electronic components are arranged. The light-emitting diodes are arranged on the same printed circuit, or on an auxiliary card. The assembly is fitted on an intermediate wall made of insulating material, and opposite the non-tight battery compartment. This intermediate wall is not tightly sealed, which leads to the compartment housing the printed circuit card and the light-emitting diodes not being tight. This results in a risk of premature aging of the electronic components.

OBJECT OF THE INVENTION

The object of the invention consists in providing an electric lighting lamp with light-emitting diodes supplied by a printed circuit card housed in a tightly sealed environment, avoiding a complicated industrial process to achieve tight sealing and limiting the number of parts.

The lighting lamp according to the invention is characterized in that the contact parts comprise second contact elements designed to successively pass through a pair of holes situated in a tight intermediate wall of the enclosure and a pair of slots of the card, soldering of the second contact elements onto the card, in addition to electric connection of the power source, enabling a tightly sealed compartment to be achieved in the enclosure around the card.

According to a preferred embodiment, the contact parts are mounted on a support wall on which the tight wall is fitted, the holes of the latter comprising sealing lips designed to come into contact with one of the faces of the card. The tight wall is advantageously equipped with fixing clips to keep the card pressing firmly on the sealing lips.

The periphery of the tight wall is provided with a seal against which the frame of a front case of the enclosure is applied. The seal is preferably molded from casting on the tight wall.

The invention also relates to a method for assembling the enclosure of a portable lighting lamp consisting in arranging contact elements on a support wall to connect a DC power source to at least one light-emitting diode controlled by a printed circuit card. The method is characterized in that:

the support wall is associated with a tight wall having holes provided with sealing lips, the printed circuit card is clipped onto the tight wall and kept pressing firmly on the sealing lips after the contact elements have been passed through the holes of the tight wall and through slots arranged on the card, the contact elements are then soldered onto the card sealing off the slots, and a front case and a rear case are fitted onto the support wall so as to obtain a tight compartment around the card and a non-tight compartment housing the power source.

BRIEF DESCRIPTION OF THE DRAWINGS

Other advantages and features will become more clearly apparent from the following description of a particular embodiment of the invention given for non-restrictive example purposes only and represented in the accompanying drawings, in which.

DESCRIPTION OF A PREFERRED EMBODIMENT OF THE INVENTION

Figure 1:
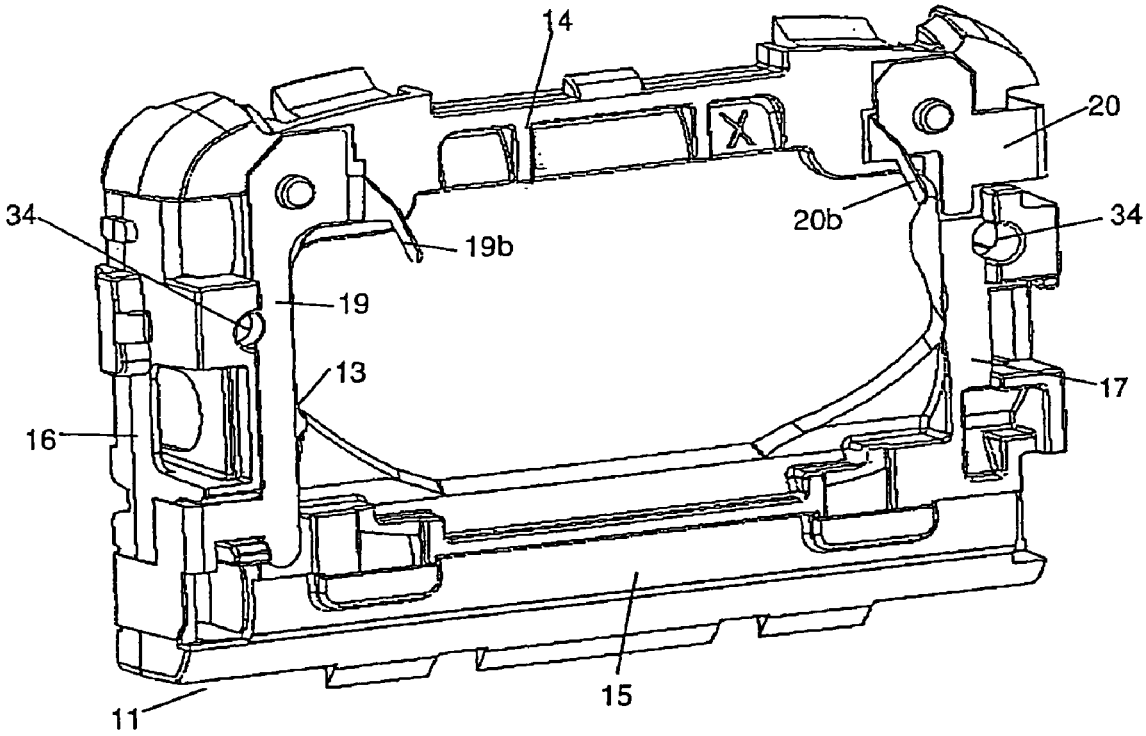
FIGS. 1 and 2 represent front and rear perspective views of the support wall of the lamp enclosure.
Figure 2:
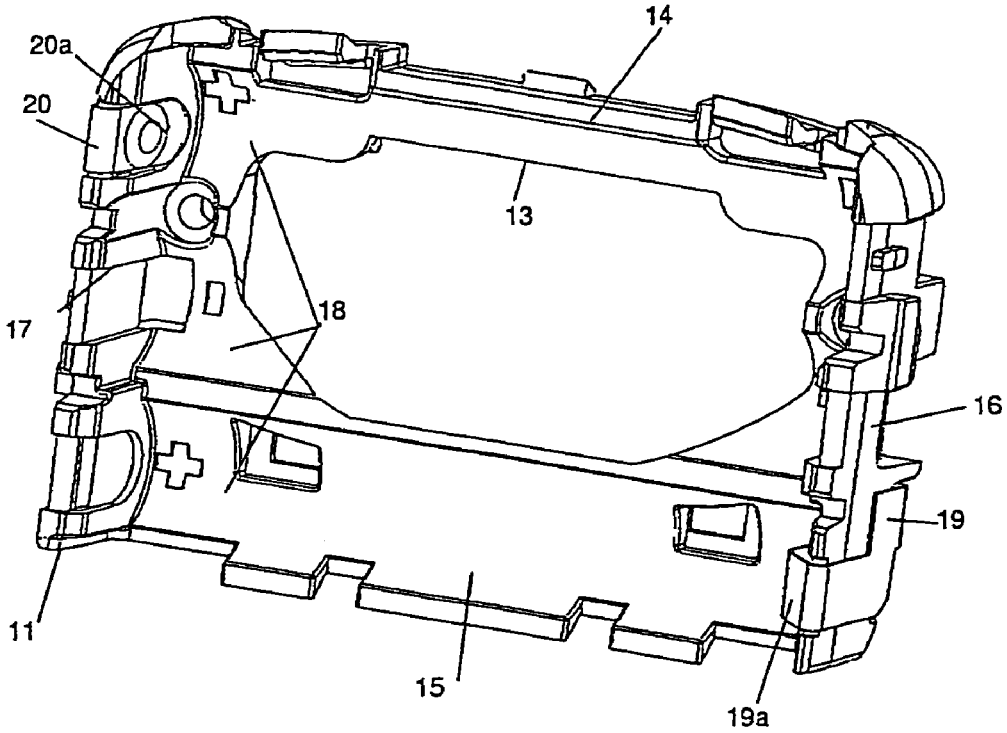
Figure 3:
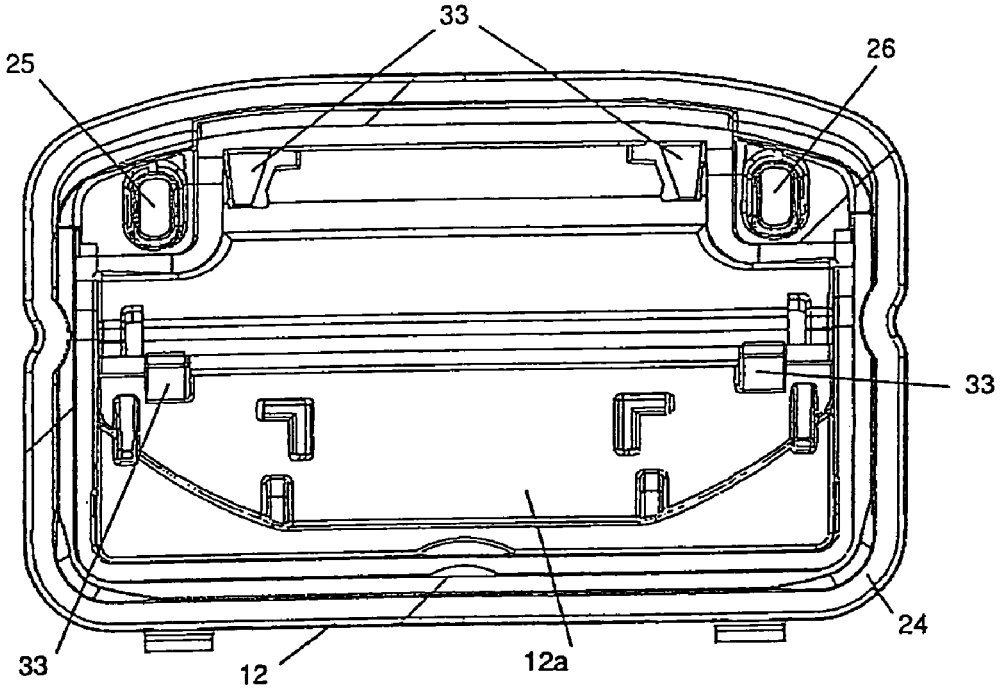
FIG. 3 shows a front view of the tight wall of the enclosure.
Figure 12:
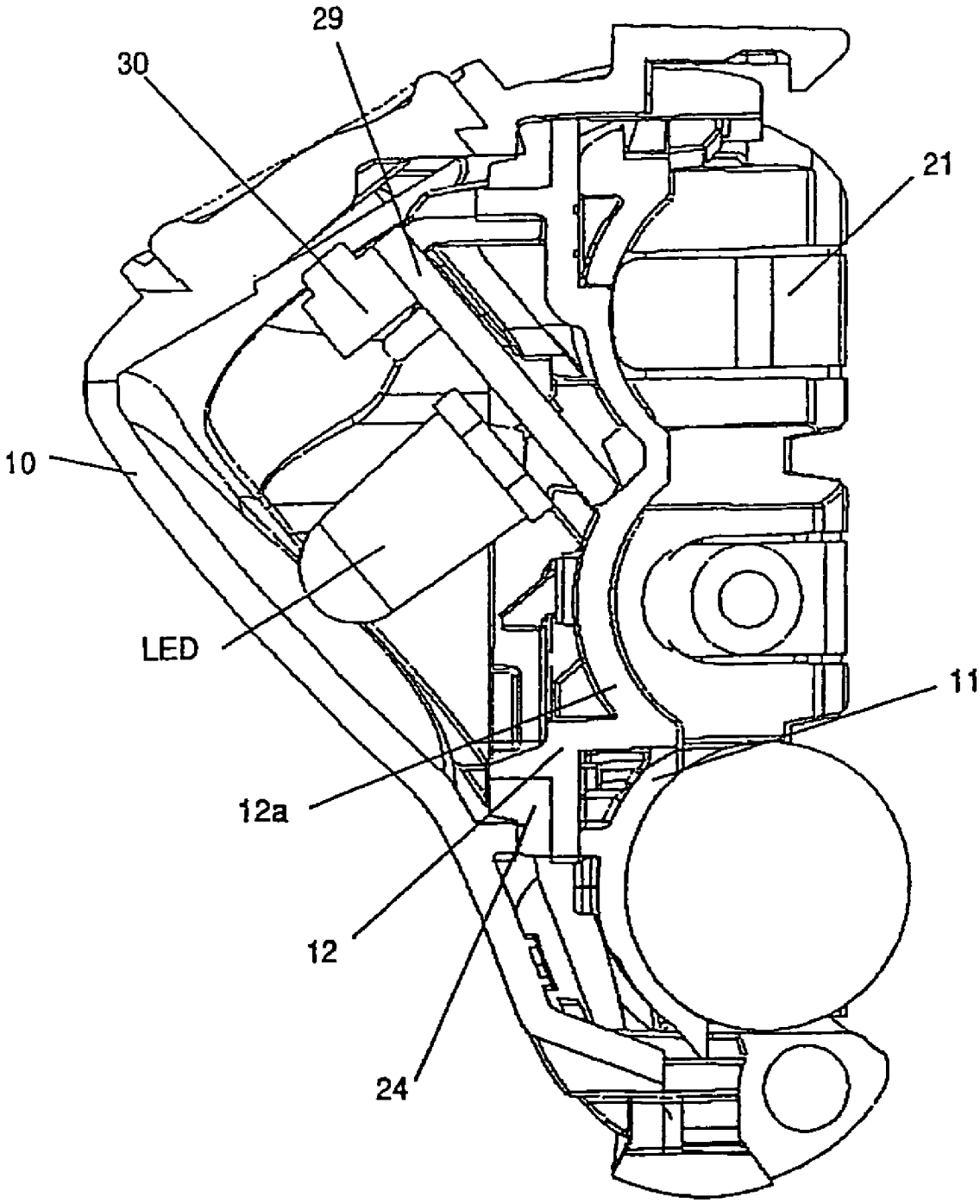
FIG. 12 shows a cross-sectional view of the lamp after final assembly of the rear case.

In the figures, the enclosure made of molded insulating material of a portable lighting lamp, in particular a headlamp, is formed by assembling a front case 10 (FIG. 9), a battery support wall 11 (FIGS. 1 and 2), a tight wall 12 (FIG. 3), and a rear case 21 (FIG. 12).

Support wall 11 and tight wall 12 are both intermediate walls inserted between front case 10 and rear case 21.

Battery support wall 11 (FIGS. 1 and 2) presents a quadrangular frame comprising a central opening 13 delineated by a top branch 14, a parallel bottom branch 15, and two opposite side faces 16, 17. The rear face of the frame of wall 11 is provided with first longitudinal recesses 18 for positioning cylindrical batteries (not shown). Side faces 16, 17 are equipped with two contact parts 19, 20 designed to be connected to the positive pole and the negative pole of the power supply unit formed by series connection of the batteries.

Each contact part 19, 20 is formed by a cut and folded copper tab having at the opposite ends a first contact element 19*a*, 20*a* arranged on the same side as the rear face of the frame and a second contact element 19*b*, 20*b* salient from the front face of support wall 11.

First contact elements 19*a* 20*a* present a predefined elasticity so as to ensure a good electric contact with the poles of the batteries. Second contact elements 19*b*, 20*b* are formed by pins facing frontwards and extending perpendicularly to top branch 14.

Figure 11:
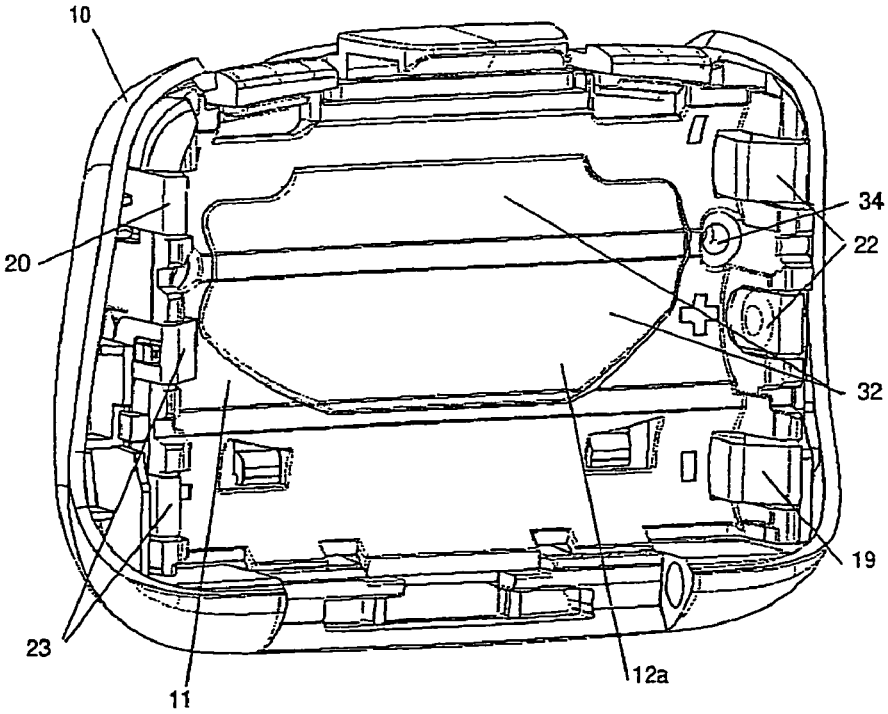
FIG. 11 is a rear view of the enclosure after the front case has been fitted on the sub-assembly of FIG. 8.

Intermediate contacts 22, 23 (FIG. 11) cover side faces 16, 17 of support wall 11 to achieve series connection of the three batteries.

Figure 4:
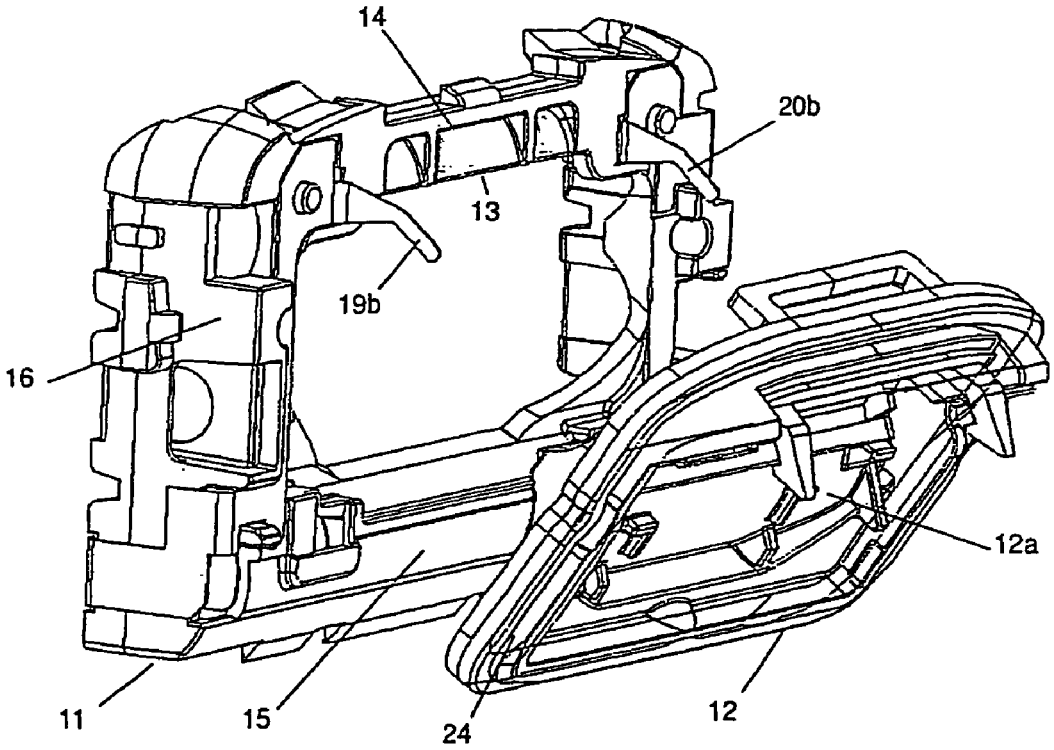
FIGS. 4 and 5 are views of assembly of the tight wall on the support wall respectively before and after the contact elements have been passed through the holes of the tight wall.
Figure 5:
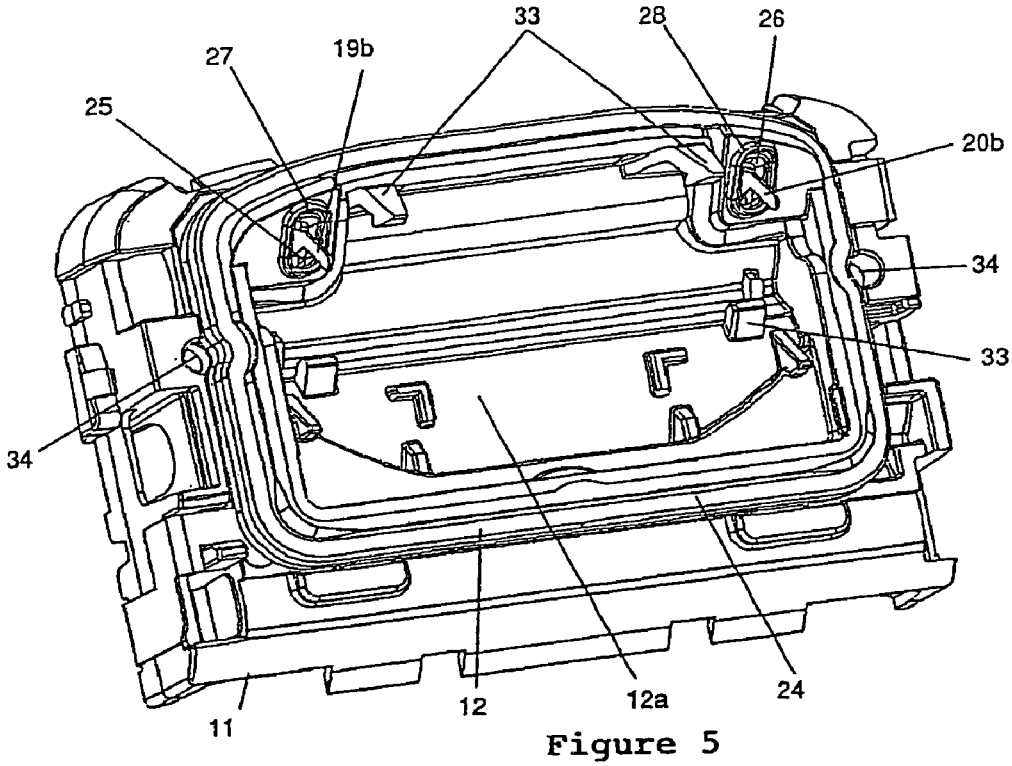
Figure 6:
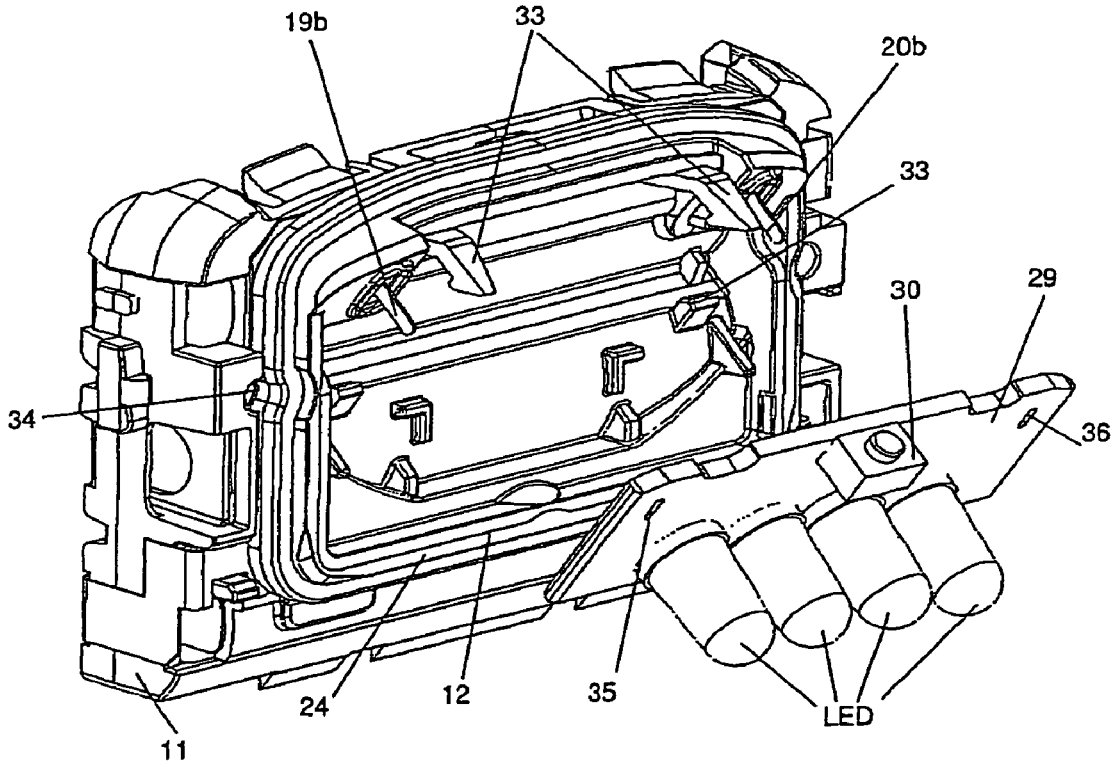
FIGS. 6 and 7 illustrate perspective views of assembly of the printed circuit card on the sub-assembly of FIG. 5.

Tight wall 12 (FIG. 3) is obtained by molding of two materials and is composed of a reinforcing wall 12*a* on which a rectangular seal 24 is molded from casting. Reinforcing wall 12*a* is made of hard plastic whereas overmolded seal 24 is made of flexible plastic material. Two holes 25, 26 are arranged in the top part of tight wall 12 to let contact elements 19*b*, 20*b* pass through when tight wall 12 is fitted on support wall 11 (FIGS. 4 and 5). The front of each hole 25, 26 is advantageously surrounded by a sealing lip 27, 28 designed to come into engagement against the printed circuit of a printed circuit card 29 (FIG. 6). Reinforcing wall 12*a* snugly fits and blanks off opening 13 of support wall 11, and further comprises second recesses 32 in continuity with first recesses 18 to form housings of semi-circular cross-sections.

Figure 7:
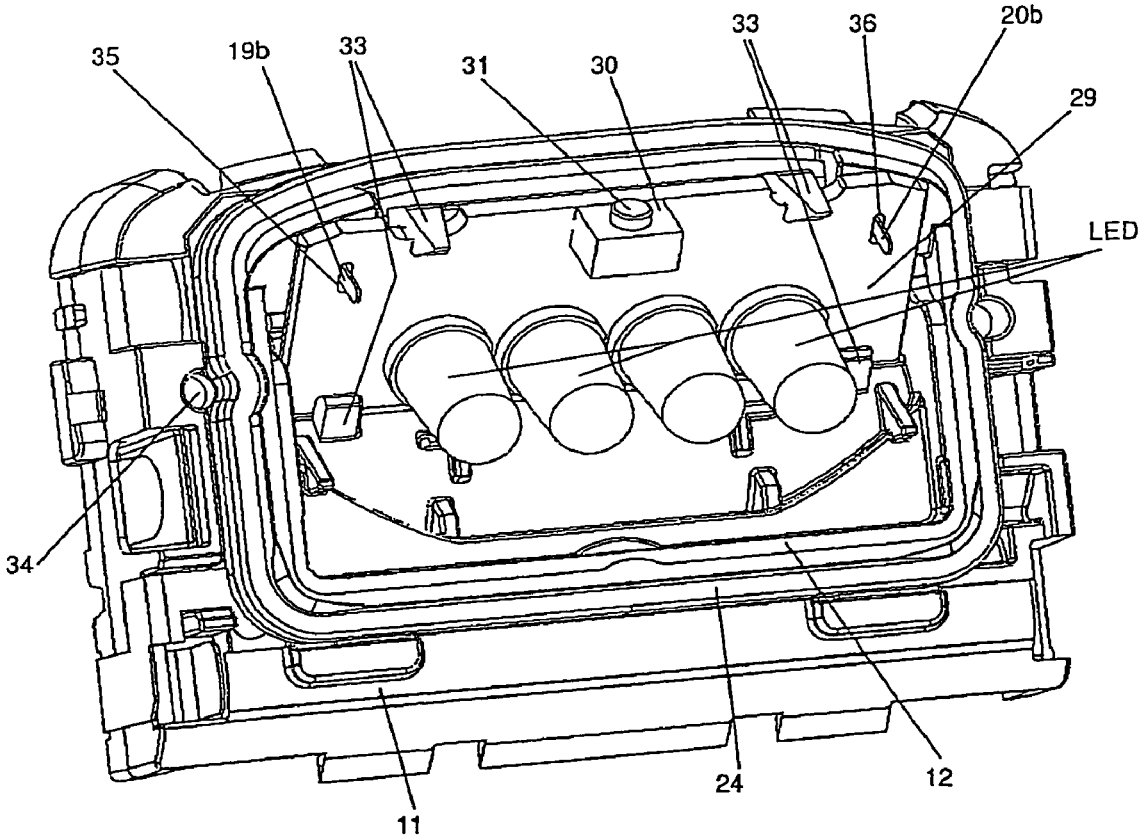
Figure 8:
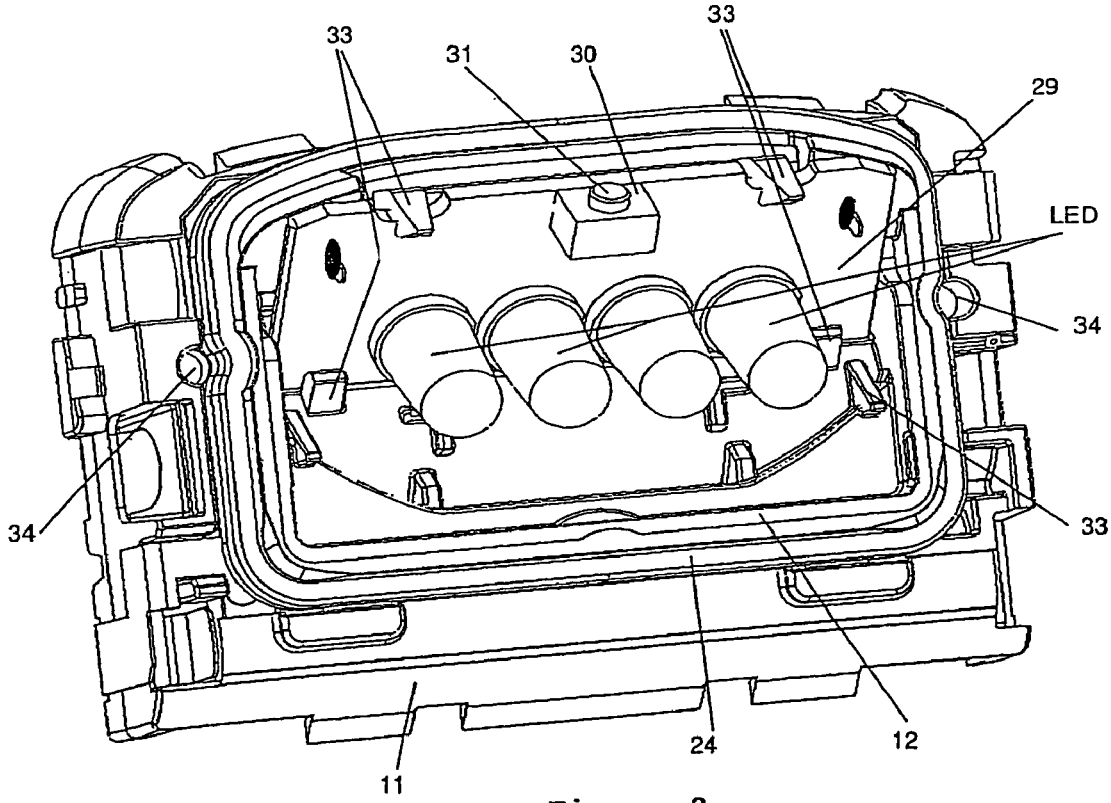
FIG. 8 shows soldering of the contact elements onto the card.

The front face of printed circuit card 29 supports light-emitting diodes LED, four in the example illustrated in FIGS. 7 and 8, to emit a lighting beam when the switch or changeover switch 30 with pushbutton 31 is actuated. The latter is provided with connecting pads electrically connected on the printed circuit of card 29. Power supply of light-emitting diodes LED can be performed directly via switch 30 or by means of a microcontroller which is connected with other electronic control components on the two opposite faces of card 29.

Tight wall 12 is further equipped with four fixing clips 33 which keep card 29 pressing firmly on sealing lips 27, 28 after second contact elements 19*b*, 20*b* have passed through slots 35, 36 (FIGS. 6 and 7) advantageously situated on the tracks of the printed circuit of card 29.

When card 29 is fixed on tight wall 12 by clips 33, second contact elements 19*b*, 20*b* are then soldered onto the conducting tracks of card 29 (FIG. 8). The solders completely fill slots 35, 36 of card 29.

Figure 9:
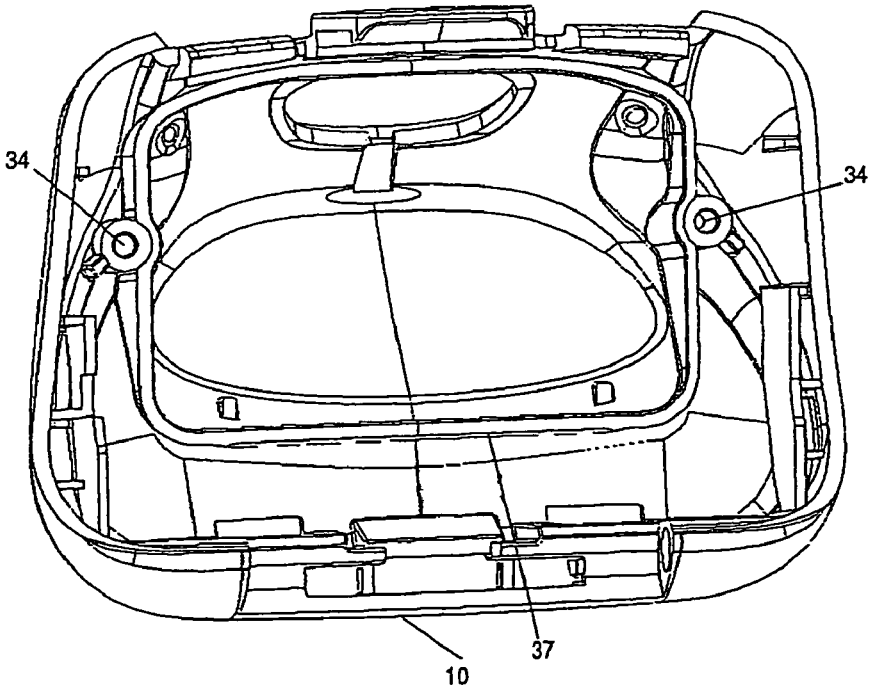
FIG. 9 represents a perspective view of the front case.

With reference to FIG. 9, front case 10 is made from transparent material or comprises at least one transparent part arranged facing diodes LED. Front case 10 fits onto the periphery of support wall 11. An internal frame 37 of front case 10 presses against the stop formed by seal 24 of wall 12.

The side faces of front case 10 and of support wall 11 further comprise holes 34 for passage of assembly screws (not shown) designed to enhance the tightness of frame 37 on seal 24.

Assembly of the different parts of the body of the lighting lamp is performed as follows:

In FIGS. 4 and 5, tight wall 12 is fitted opposite seal 24 on the front face of support wall 11 with second contact elements 19*b*, 20*b* passing through holes 25, 26.

In FIGS. 6 and 7, printed circuit card 29 with diodes LED is fixed onto tight wall 12 by means of the four clips 33. Second contact elements 19*b*, 20*b* pass through slots 35, 36 and rear face of card 29 is kept pressing firmly on sealing lips 27, 28.

In FIG. 8, second contact elements 19*b*, 20*b* are soldered onto the conducting tracks of card 29 filling slots 35, 36.

Figure 10:
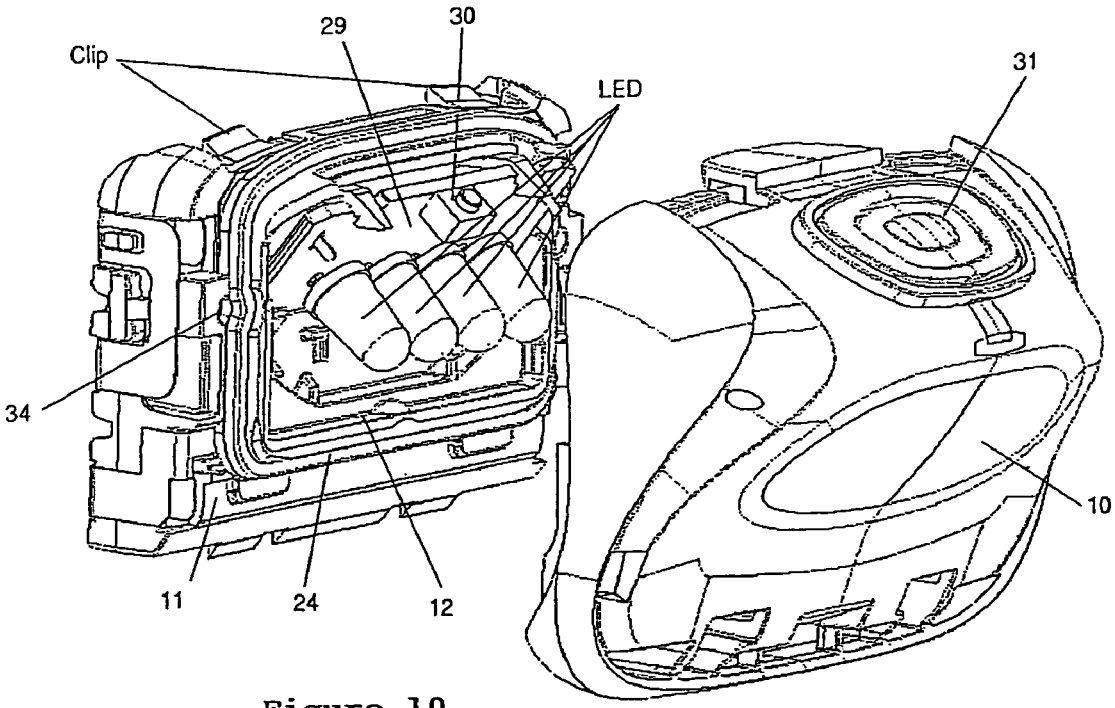
FIG. 10 shows an exploded perspective view of the front case on the sub-assembly of FIG. 8.

FIG. 10 shows assembly of front case 10 on the assembly formed by walls 11, 12 and card 29.

Rear case 21 then simply has to be fitted (FIG. 12) on the rear face of support wall 11.

The two faces of printed circuit card 29 are thus housed in a tight environment on both sides of the printed circuit due to the presence of sealing lips 27, 28 pressing firmly on the rear face of card 29, of second contact elements 19*b*, 20*b* soldered directly from the front onto the conducting tracks of card 29, and of frame 37 kept pressing firmly against seal 24 by the assembly screws.

Such a tight environment around card 29 enables the electronic components to be protected against oxidation and corrosion. Diodes LED are also housed in this tight environment. The battery compartment between rear face of support wall 11 and rear case 21 remains a non-tight environment.

It is clear that there can be any number of light-emitting diodes LED on card 29. A single high-power diode LED can be arranged in the center of card 29.

The invention claimed is:

1. A lighting lamp having an enclosure housing:

a DC power source electrically connected by contact parts to a printed circuit card supplying at least one light-emitting diode, said contact parts having first contact elements in electrical connection with the DC power source, and a switch controlling a state and a lighting level of said light-emitting diode, wherein the contact parts comprise second contact elements designed to successively pass through a pair of holes situated in a tight intermediate wall of the enclosure and a pair of slots of the printed circuit card, soldering of the second contact elements onto the printed circuit card, in addition to electric connection of the DC power source, enabling a tightly sealed compartment to be achieved in the enclosure around the printed circuit card, the contact parts are mounted on a support wall on which the tight intermediate wall is fitted, and the holes of the tight intermediate wall comprise sealing lips designed to come into contact with one of the faces of the printed circuit card.

2. The lighting lamp according to claim 1, wherein the tight intermediate wall is equipped with fixing clips to keep the printed circuit card pressing firmly on the sealing lips.

3. The lighting lamp according to claim 1, wherein a periphery of the tight intermediate wall is provided with a seal against which a front case of the enclosure is applied.

4. The lighting lamp according to claim 3, wherein the seal is molded from casting on the tight intermediate wall.

5. The lighting lamp according to claim 3, wherein the front case comprises a transparent part arranged facing the light-emitting diode and a frame coming up against a stop formed by the seal of the tight intermediate wall.

6. The lighting lamp according to claim 1, wherein a rear case is fitted on the support wall to delineate a battery compartment.

7. A method for assembling the enclosure of a portable lighting lamp consisting in arranging contact elements on a support wall to connect a DC power source to at least one light-emitting diode controlled by a printed circuit card, the method wherein:

the support wall is associated with a tight wall having holes provided with sealing lips, the printed circuit card is clipped onto the tight wall and kept pressing firmly on the sealing lips after the contact elements have been passed through the holes of the tight wall and through slots arranged on the printed circuit card, the contact elements are then soldered onto the printed circuit card sealing off the slots, and a front case and a rear case are fitted onto the support wall so as to obtain a tight compartment around the printed circuit card and a non-tight compartment housing the DC power source.

8. The method for assembling according to claim 7, wherein a seal is molded from casting on the tight wall, and a frame of the front case is applied against said seal when final assembly of the enclosure is performed.

* * * * *